United States Patent [19]

Darnell et al.

[11] Patent Number: 4,834,000

[45] Date of Patent: May 30, 1989

[54] LOAD AND ROLL PALLET

[76] Inventors: James Darnell; Ralph Defalco, both of 4601 W. 12th St., Alsip, Ill. 60658

[21] Appl. No.: 70,157

[22] Filed: Jul. 1, 1987

Related U.S. Application Data

[63] Continuation of Ser. No. 762,857, Aug. 6, 1985, abandoned.

[51] Int. Cl.[4] ..... B65D 19/00

[52] U.S. Cl. ..... 108/51.1; 108/55.1

[58] Field of Search ..... 108/51.1, 55.1, 57.1; 224/42.44, 310, 311, 42.42; 206/599

[56] References Cited

U.S. PATENT DOCUMENTS

| | | | |
|---|---|---|---|
| 493,980 | 3/1893 | Coler . | |
| 577,471 | 2/1897 | Ward . | |
| 1,522,707 | 1/1925 | Andrews et al. | 108/55.1 X |
| 1,574,501 | 2/1926 | O'Brien | 108/55.1 X |
| 2,113,346 | 4/1938 | Heath | 297/325 X |
| 2,152,086 | 3/1939 | Powell | 108/57.1 |
| 2,498,146 | 2/1950 | Trotter . | |
| 2,534,010 | 12/1950 | Frye | 108/55.1 X |
| 2,649,217 | 8/1953 | Mertes . | |
| 2,687,310 | 8/1954 | Goetz | 108/55.1 X |
| 2,716,872 | 9/1955 | Test . | |
| 2,744,710 | 5/1956 | Gerosa | 248/129 |
| 2,828,040 | 3/1958 | Fitton et al. | 108/55.1 X |
| 2,841,302 | 7/1958 | Reisman et al. | 108/55.1 X |
| 2,947,565 | 8/1960 | Wood | 108/55.1 X |
| 3,025,058 | 3/1962 | Brumfield | 248/129 X |
| 3,118,400 | 1/1964 | Kemp, Jr. et al. | 108/57.1 |
| 3,259,432 | 7/1966 | Jackson | 248/129 X |
| 3,294,041 | 12/1966 | Lessheim | 108/51.1 |
| 3,297,175 | 1/1967 | Gooding | 108/55.1 X |
| 3,602,157 | 8/1971 | Cohen | 108/51.1 |
| 3,651,970 | 3/1972 | Black . | |
| 3,667,635 | 6/1972 | Hackney . | |
| 3,729,215 | 4/1973 | Paakkinen . | |
| 3,817,413 | 6/1974 | Ham . | |
| 3,837,663 | 9/1974 | Ness . | |
| 3,882,796 | 5/1975 | Andrein et al. | 108/51.1 |
| 3,883,020 | 5/1975 | Dehn . | |
| 3,938,678 | 2/1976 | Kern . | |
| 4,159,060 | 6/1979 | Buse . | |
| 4,231,695 | 11/1980 | Weston, Sr. . | |
| 4,240,555 | 12/1980 | Jurasek | 108/55.1 X |
| 4,344,368 | 8/1972 | Remington et al. | 108/55.1 X |
| 4,347,794 | 9/1982 | Nordstrom | 108/51.1 |
| 4,410,385 | 11/1983 | Clare et al. | 108/55.1 X |

*Primary Examiner*—Kenneth J. Dorner
*Assistant Examiner*—José V. Chen

[57] ABSTRACT

A rollable pallet for insertion into an open end of a container compartment or a semi-trailer compartment. The pallet includes a rectangular frame having a flat base plate adapted to rest on the floor of the container compartment. The front end of the frame is elevated and a roller which also rests on the floor is mounted thereon to provide support for the frame and to provide a pivot about which the frame is tilted when the rear end of the frame is lifted. When tilted the pallet is rollable on the floor of the container.

10 Claims, 4 Drawing Sheets

3
100
88
16
55
10
90
86
12
30
14
18
15
102
58
56
60
62
94
92
34
20
38
44
42
46
54
52
50
48
22
5
α

LOAD AND ROLL PALLET

This is a continuation of application Ser. No. 762,857, filed Aug. 6, 1985, now abandoned.

BACKGROUND OF THE INVENTION

1. Field of the Invention

The present invention relates to pallets and more particularly to a pallet adapted for use in an end loading type of intermodal container adapted for shipment by rail, sea or air and in an end loading type of cargo compartment of a semi-trailer truck.

2. Description of the Prior Art

Semi-trailer cargo compartments and standarized intermodal containers of the above type are generally end loaded. Particularly with high density and elongated objects, the loading of such containers becomes time consuming, difficult to achieve with a proper load distribution, and expensive. For example, steel coils, bars and pipes may be particularly troublesome.

Moreover, the cargo may be of the type which requires special handling, tie downs and the like which are not readily accomplished within the confined space of the cargo compartment of the above type of container.

Intermodal containers and many semi-trailer vans have standarized or fixed cross-sectional dimensions of about 20 feet by 8 feet. The height of the container is also fixed by similar standards. When a semi-trailer van is of such standerized dimensions, the vans and/or containers maybe hauled in tandem so as to be within the length limitations dictated by local, state, or federal regulations.

In accordance with the present invention, it is proposed to provide a pallet structure which may be accomodated with such standardized dimensions so as to effectively use the entire cargo carrying cross-sectional area of the container or van.

It is further proposed to provide a pallet which may be loaded with the entire cargo outside of the container or the cargo compartment and thereafter lifted and rolled into the container or the cargo compartment of the van.

It is further proposed to construct the pallet in such a manner that when the pallet is positioned in the container or the cargo compartment no further tie downs need be used to secure the pallet in place.

It is further proposed to construct the pallet in such a manner that no modification of the van or container is required to accommodate the pallet.

Prior efforts to provide the foregoing proposed pallets have either been cumbersome or required the modification of the carrying vehicle or compartment. Such prior art efforts are exemplified by U.S. Pats. Nos. 2,498,145 and 4,231,695.

Still other pallet structures require that the pallet be frictionally pushed on the compartment floor boards to position the pallet within the compartment. Still others require a fork lift truck to enter the container or cargo compartment to properly place the loaded pallet in the container. When this is done, it frequently results in damage to the compartment floor structure.

SUMMARY OF THE INVENTION

The present invention overcomes the difficulties encountered heretofore by providing means for rolling the loaded pallet into position and rendering the rolling means ineffective without the need for additional tie downs or the like when properly positioned. The pallet is constructed such that the cargo or load secured thereon is uniformly distributed to the underlying floor structure of the container or cargo compartment.

More particularly, the pallet includes a frame having roller means adjacent one end and a base means for frictionally engaging the van or container floor. The frame is constructed such that the base normally rests on a planar floor support structure, and when tilted upwardly at the end opposite the roller, the frame is lengthwise movable on the roller.

Accordingly, the cargo or freight maybe secured and loaded on the pallet outside of the container or cargo compartment and thereafter inserted into the container or cargo compartment and tilted and rolled into the compartments. When in this desired position within the compartment, the loaded pallet is returned to its normal at rest position so the base frictionaly engages the floor to prevent movement. The weight of the pallet and the cargo will be effective as to retain the loaded pallet positioned therein.

To facilitate securing of the cargo on the pallet, the latter may be provided with wooden flooring, tie downs rails, stake openings and the like.

Further objects and features of the invention will hereinafter appear.

DESCRIPTION OF THE PREFERRED EMBODIMENT

Figures 1, 2:
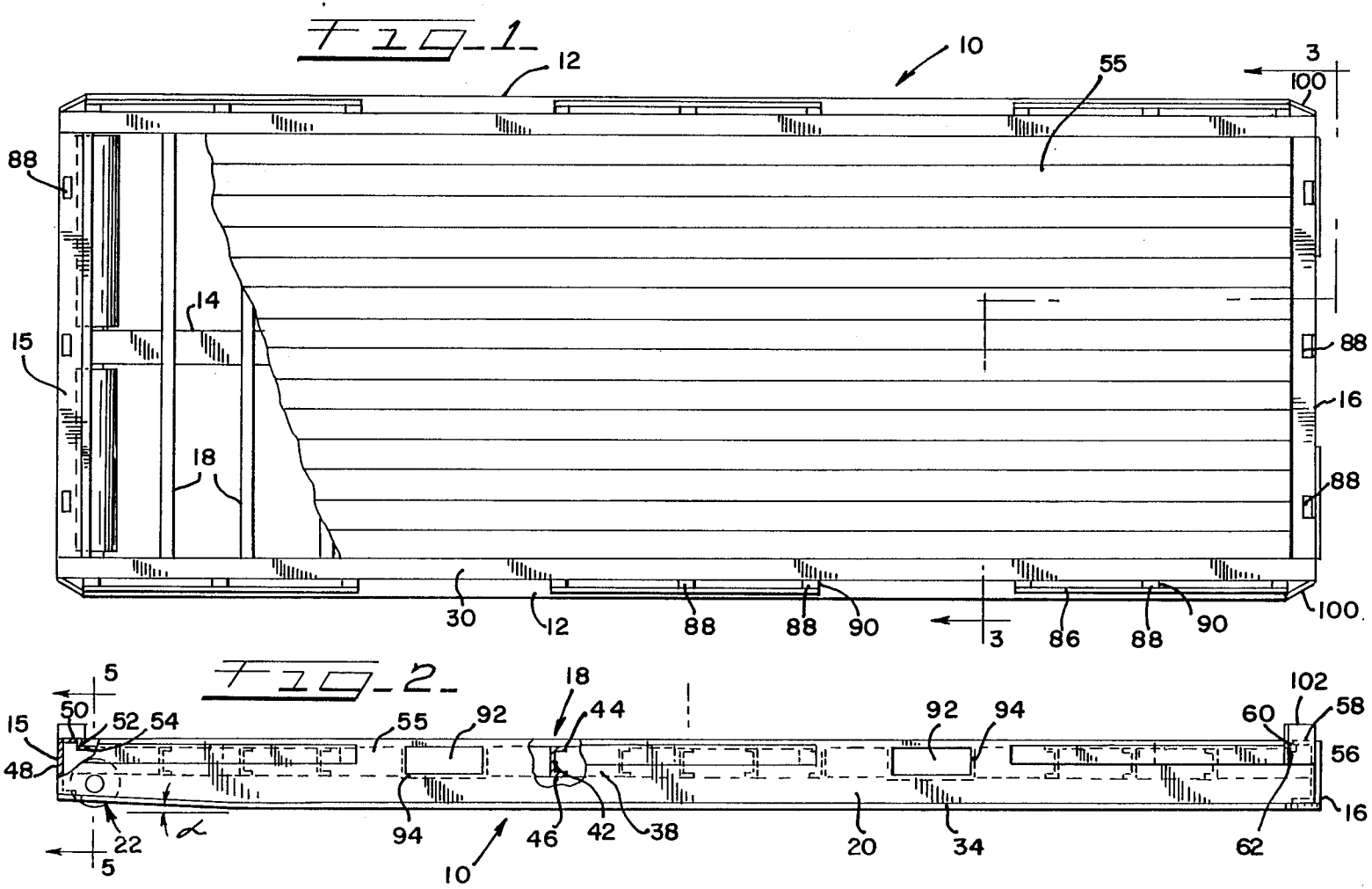
FIG. 1 is a fragmentary top plan view of the pallet of the present invention with parts being broke away to show underlying details of structure.
FIG. 2 is a fragmentary side elevational view of the pallet with parts broken away to show underlying details of structure.
Figure 3:
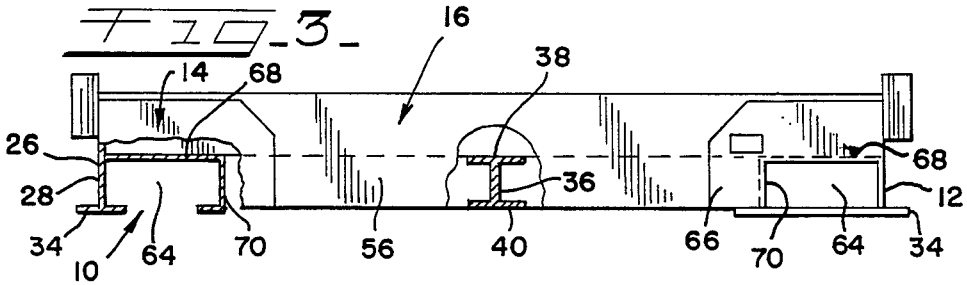
FIG. 3 is a fragmentary end view of the pallet taken generally along the lines 3—3 of FIG. 1.
Figure 4:
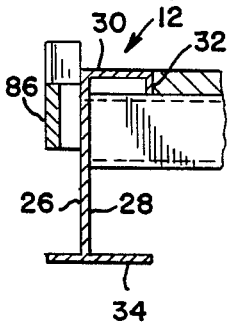
FIG. 4 is an enlarged fragmentary end view of a corner of the pallet.

Referring now to FIGS. 1, 2, and 3 there is a pallet 10 embodying the structure of the present invention. The pallet 10 generally includes a pair of longitudinally extending and laterally spaced side members 12, a center beam 14, a front or forward end member 15, and a rear end member 16. Extending between the side members or plates 12 and supported on the center beam 14 are a plurality of longitudinally spaced cross members 18. The side members 12, center beam 14, end members 15 and 16, and cross members 18 form a frame 20.

A roller assembly 22 is mounted adjacent the front end member 15, and extends between the side plates 12. The roller assembly 22 serves to permit the pallet 10 to be rolled endwise when the frame is tilted as more fully to be explained hereinafter.

As constructed, the length and width dimensions of the pallet 10 are such that the pallet will fit into a standard size intermodal container. Moreover, the structure of the pallet distributes the carried load to the container floor.

As shown in FIGS. 1–4, the side members 12 each include a plate 26 of generally inverted J-shape cross section. The inverted J-plate 26 includes an upright leg 28 from the end of which there extends a horizontal ledge which terminates in a downwardly depending lip 32. Fixed to the edge of the leg 28 is a horizontal base plate 34 which serves as a support surface and at the same time strengthens the side member 12.

Disposed substantially intermediate or in between the side members 12 is the center beam 14 which may be in the form of an I-beam having an upstanding web 36, an upper ledge 38, and a lower base plate 40. The base plate 40 lies slightly above the plane formed by the base plates 34.

As shown in FIG. 2, the cross members 18 are in the form of C-shaped channels having a vertical web 42 and upper and lower legs 44 and 46 respectively. The ends of the cross members 18 are suitably fixed to the upright legs 28 of the side members 12 and the lower legs 46 rest on the upper ledge 38 of the I-beam center beam 14.

The front or forward end member 15 as shown in FIG. 2 includes a downwardly depending end plate 48 having an inwardly extending horizontal ledge 50 above the upper end. A flange 52 depends downwardly from the ledge 50 and terminates in a horizontal inwardly projection lip 54. The lip 54 is disposed in substantially the same plane as the surface of the upper channel legs 44 to provide a surface on which wooden flooring 55 is supported. The forward member 15 is suitably fixed to side members 12 as by welding. It is to be observed that any suitable flooring may be used with the pallet.

The rear end member 16 includes an end plate 56, ledge 48, downwardly depending flange 60 and a lip 62. The lip 26 serves to assist in supporting the flooring 55. The flooring 55 facilitates the nailing and securing of different types of cargo on the pallet 10. The end member 16 is formed with rectangular lift pockets 64 to accomodate the tines of a fork lift truck. A reinforcing plate 66 may be placed about the lift pockets 64. The lift pockets also may include inwardly extending wall 68 and 70 to form tubular openings.

The forward end of the side members 12 and the center beam 14 are inclined upwardly for a predetermined lengthwise distance. The upward angle of inclination is determined such that the roller assembly 22 provides the sole point of contact with the ground or floor of the container when the rear end of the pallet is tilted or lifted upwardly. The angle of inclination is designated by the angle $\alpha$.

Figure 5:
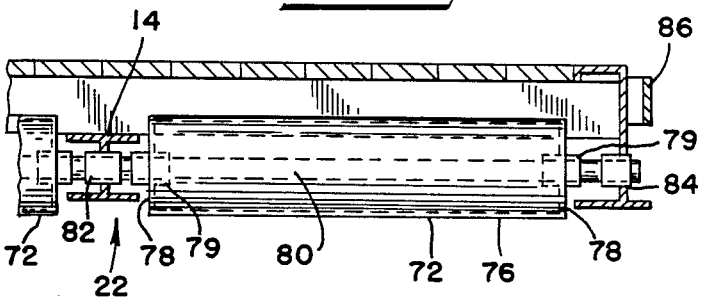
FIG. 5 is a cross sectional fragmentary end view taken generally along the lines 5—5 of FIG. 2 and showing the details of the roller assembly.

The roller assembly 22 as shown in particular in FIG. 5 includes two side-by-side rollers 72. The rollers 72 are each of similar structure and include a cylinder or tube 76 of which the ends are plugged by disks 78. Extending from the disks 78 at each end are tubular sleeves 79 through which there extends shaft 80. The shaft 80 is suitably fixed to the sleeves 79 as by set screws or the like. Fixed in the vertical or upstanding web 36 of the center beam 14 is a journal sleeve 82 which receives the shaft 80. The ends of the shaft 80 are journaled in bearings 84 mounted on the J-plate 26.

Rails 86 may be fastened between stake openings 88 to provide suitable fastening means for chains, ropes and other loading tie downs devices. U-shaped clips or channel 90 are welded to the sides of the side members 12 to form side stake openings. The stake openings 88 serve to receive stakes as are usually used to prevent shiftings of the load carried on the pallet. Similar stake openings may be provided in the upper ledges of the end members.

Formed in each of the side members 12 are aligned lift pockets 92. The aligned lift pockets are connected by tubular sleeves 94. In this manner the lift pockets extend through the entire width of the pallet 10 and thereby facilitate the insertion of the fork lift tines to transport the pallet as shown in FIG. 6.

Figure 6:
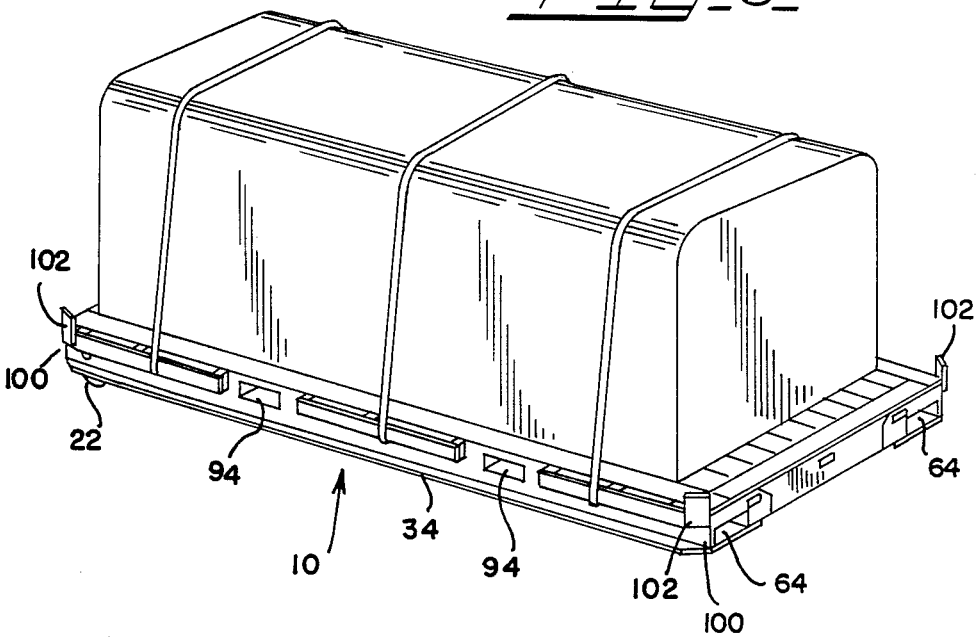
FIGS. 6, 7, 8, 9, 10, and 11 are schematic illustrations of the sequential steps of the insertion a loaded pallet comprising this invention into a container or cargo compartment.

As shown in particular in FIGS. 1 and 6, the corners 100 of the frame 20 where the side members 12 and the end members 15 and 16 intersect are chamferred,and an upstanding stacking plate 102 is suitably attached to the frame to provide for stacking of pallets 10 for storage or redistribution.

Figure 7:
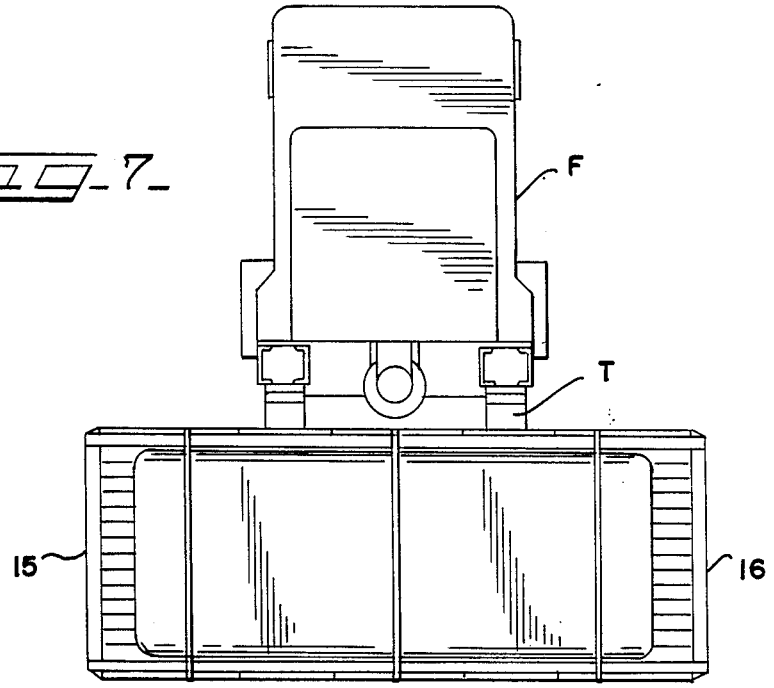
Figure 8:
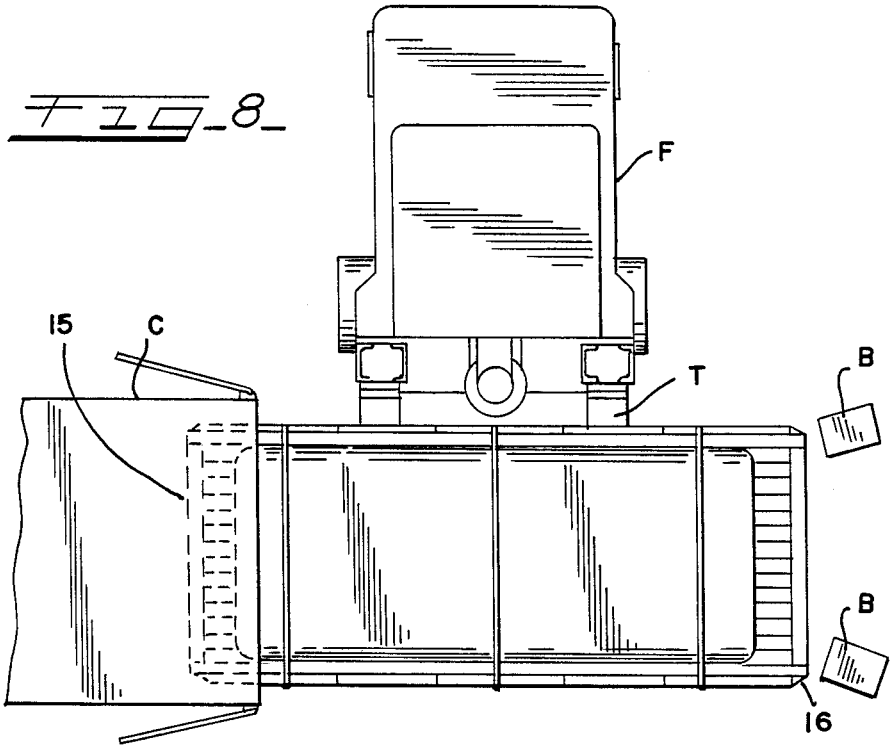
Figure 10:
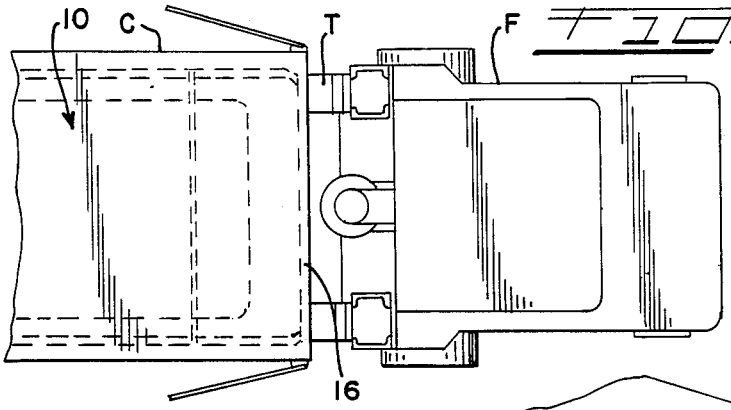
Figure 11:
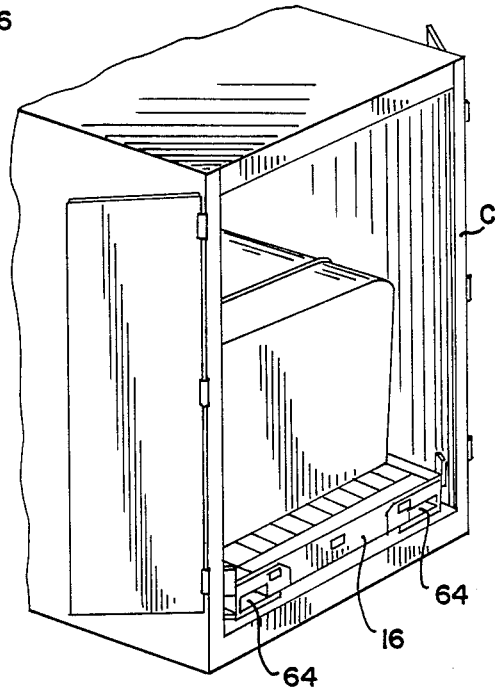
Figure 9:
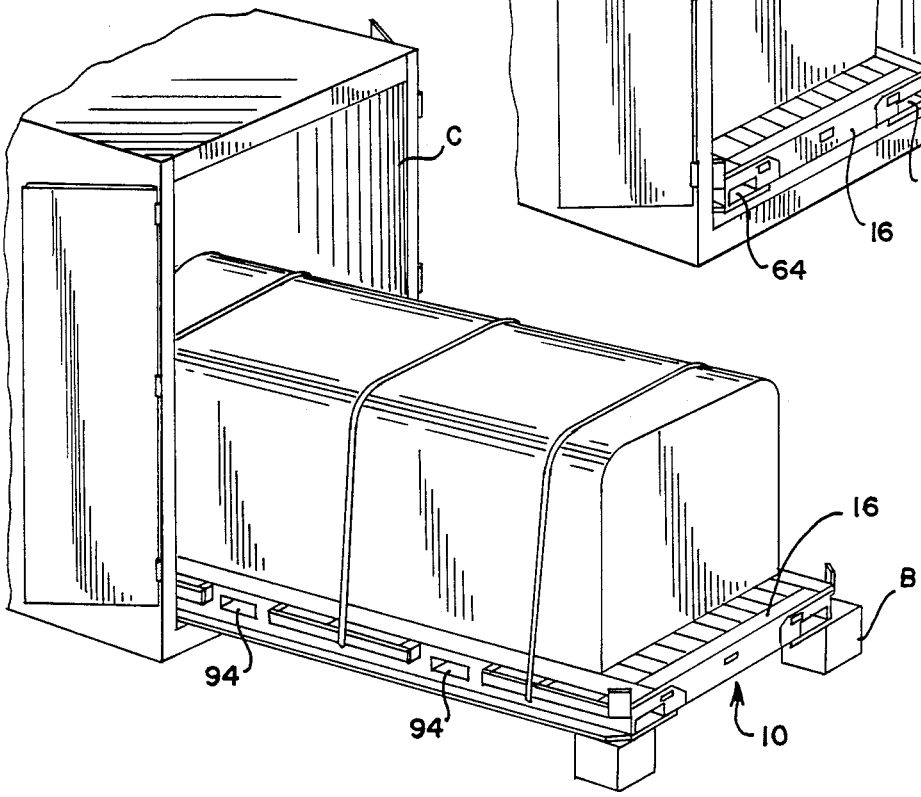

In operation, a pallet 10 is loaded and is prepared for shipment at a convenient location outside of the container. The cargo is securley fastened to the pallet by means of stakes and the usual tie downs means. After the pallet is loaded or prepared for shipping and the cargo secured thereon, a fork lift truck is used to place the pallet in a container or semi-trailer van C. To this end the tines of the fork-lift truck F are inserted into the side lift pockets 94 as shown in FIG. 7.

Assuming the pallet 10 is to be transported by an intermodal container C having a rear opening as shown in FIGS. 8, 9, 10, and 11, the fork lift truck positions the pallet 10 with one end, usually the forward end, in alignment with the door opening. The tines are then laterally shifted so that the forward end of the loaded pallet 10 is inserted through the door opening. The pallet 10 is then lowered so that the forward end in the container is supported therein by the rollers 72 and the opposite end is suitably supported on blocks B or other support means.

The tines are then removed from the side lift pockets 94 and the fork lift F is moved to the rear of the pallet 10 which is supported on the blocks B. The tines are then inserted into the end wall lift pockets 64 and raised upwardly so as to tilt the pallet 10. Such tilting occurs about the rollers 72 and is permitted by the upwardly inclined forward ends of the frame 10. The pallet 10 is raised at one end sufficiently such that the rollers 72 are making the sole contact with the container floor. This permits the fork lift truck to move toward the container and roll the loaded pallet into the Container C. When completely located within the container C and in the desired position, the tines T are lowered so that the loaded pallet is now resting on the container floor supported in frictional engagement with the container floor by means of the base plates 34 of the side members 12. The tines T are then removed from the lift openings 64 and the fork lift truck F is moved to another location. In rest position the entire length of the side members 12 are in contact with the container floor, except for the inclined forward ends thereof. The surface of the rollers 72 is tangent with the plane of the bottom surfaces 30 of the base plate 34 of the side members, so that the rollers support a minor portion of the load of the pallet, when the pallet is at rest after the forklift truck has been removed. Thus, the load of the pallet is distributed approximately evenly around the outer periphery of the container floor by means of the rollers 72, the base plates 32 and the rear end member 16. This allows the load to be borne by the strongest part of the container, namely the area of the container floor adjacent the vertical walls of the container.

Obviously, unloading is achieved in a reversed manner. A cargo carrying van may be similiarly loaded in the manner described above in connection with the container C.

What is claimed is:

1. A lading carrying pallet having a body which defines a front end, a back end, a pair of side edges, and a lading carrying upper surface, said pallet constructed for positioning on the floor of a lading carrier wherein the improvement comprises:

said pallet including support members, each having a bottom associated with each of said side edges and said bottom extending below the body of the pallet for engaging a carrier floor, for spacing said pallet body from said floor and for distributing weight to the carrier through the support means;

a center beam member for said pallet body extending from the pallet front end toward the pallet back end, spaced between the pallet upper surface and the bottoms of the support members;

rolling means mounted to said pallet body across the front end thereof for selective engagement and distributing of weight to the carrier floor and for positioning of the pallet thereon; and said rolling means being mounted to said pallet body so that said rolling means is spaced between the lading carrying upper surface and the bottom of the support members, each of said side edges constructed so as to define a rolling means exposing space, said rolling means being rotatably mounted to said side edges and said center beam so that when said back end of said pallet is raised so as to tilt the pallet body beyond a predetermined angle, said rolling means only engages the floor for supporting said pallet as it is moved along said floor for positioning.

2. A pallet as in claim 1, wherein said rolling means extend across substantially the full width of the front of the pallet body.

3. A pallet as in claim 2, wherein said rolling means comprises a pair of elongated rollers, one rotatably mounted to a side edge and the center beam and the other to the center beam and the other side edge.

4. A pallet as in claim 1, wherein said side edges are shaped at the front end thereof so as to define an upwardly inclined edge extending from the bottom toward the front end so as to define a roller exposing space at said front end.

5. A pallet as in claim 1 having means defining at least two lift pockets in each of said sides and said back ends for use in lifting said pallet.

6. A pallet as in claim 1 including means defining a plurality of stake openings along each of said side edges and each of said ends, each of said openings constructed for use in securing lading to said pallet body.

7. A pallet as in claim 1 which further includes a plurality of upstanding stacking flanges, each secured to said pallet body and extending beyond the lading carrying surface and adapted to engage a second pallet thereon for nesting a second pallet on the lading supporting surface of said first pallet.

8. A pallet as in claim 7, wherein there is provided a stacking flange at each corner of said pallet body for restraining longitudinal and transverse movement of a second pallet nesting on the lading supporting surface of said pallet.

9. A pallet as in claim 1, wherein each side members includes an outboard surface and there is further provided a plurality of tie-down means, at least one of which is secured to the outboard surface of each side member for cooperating in tying down and securing the lading on the lading support surface of said pallet.

10. A pallet as in claim 1, wherein there is provided a pair of support members, one member of the pair associated with each side edge, and each member of the pair extending below the pallet body.

* * * * *